US006489712B1

(12) United States Patent
Vriens et al.

(10) Patent No.: US 6,489,712 B1
(45) Date of Patent: Dec. 3, 2002

(54) CRT WITH IMPROVED SLOTTED MASK

(75) Inventors: Leendert Vriens, Knegsel (NL); Rudolf Maria Jozef Voncken, Eindhoven (NL); Daniël Den Engelsen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 173 days.

(21) Appl. No.: 09/702,345

(22) Filed: Oct. 31, 2000

(30) Foreign Application Priority Data

Nov. 4, 1999 (EP) ..... 99203635

(51) Int. Cl.[7] ..... H01J 29/80
(52) U.S. Cl. ..... 313/402; 313/403
(58) Field of Search ..... 313/402, 403, 313/407, 408

(56) References Cited

U.S. PATENT DOCUMENTS

| | | | | |
|---|---|---|---|---|
| 4,942,332 A | | 7/1990 | Adler et al. | 313/402 |
| 5,877,586 A | * | 3/1999 | Aibara | 313/402 |
| 6,242,855 B1 | * | 6/2001 | Caronna et al. | 313/402 |

* cited by examiner

*Primary Examiner*—Robert H. Kim
*Assistant Examiner*—Elizabeth Gemmell
(74) *Attorney, Agent, or Firm*—Aaron Waxler

(57) ABSTRACT

A cathode ray tube having a tensioned shadow mask with elongated holes, i.e. holes with a length longer than 5 mm. The pattern of holes repeats itself after 5 or more rows and the relation between the number of rows after which the pattern repeats itself, the vertical pitch $a_v$ and the horizontal pitch $d_h$ is given by $a_v/d_h \leqq n^2 \leqq 8a_v/d_h$, most preferably $n^2 \approx 2a_v/d_h$.

6 Claims, 2 Drawing Sheets

2/2

CRT WITH IMPROVED SLOTTED MASK

BACKGROUND OF THE INVENTION

The invention relates to a CRT (cathode ray tube) with a colour selection electrode having rows of elongated openings. The colour selection electrode is also called a 'mask'. More in particular it relates to a CRT with a tensioned colour selection electrode in which electrode tension is applied in one direction and the colour selection electrode comprises elongated openings in said direction, the openings being separated from each other in said direction by bridges, the dimension of said openings in said direction being more than 5 mm. Basically such a design is half-way in between two conventional designs, the conventional slotted shadow mask, in which many small (typically smaller than 1.5 mm) elongated or round holes are made, and the so/called tension or 'slit' mask, in which a large number of strips are put under tension. The strips are throughout their length (typically 20 or more centimeter) separated by slits. Both of the conventional designs have shortcomings, the conventional shadow mask absorbs much of the electrons, reducing the intensity of the image, whereas the 'slit mask' is very sensitive for microphony and difficult to handle.

A CRT of the in the opening paragraph described type is known from U.S. Pat. No. 4,942,332.

In U.S. Pat. No. 4,942,332 a slit-type flat foil tension mask is described having slits with large (in comparison to conventional masks) longitudinal dimensions. Typically the length of the slits is of the order of 1 inch.

The bridges in between the slits provide mechanical strength to the tensioned colour selection electrode, without substantially reducing the image brightness or deforming the mask when the mask is put under tension. However, they also pose a problem in that the bridges may be visible as two straight horizontal lines, reducing the image quality.

In U.S. Pat. No. 4,942,332 two possible solutions for this problem are described, one being constituted by randomising the length (pitch) of the slits and another being constituted by introducing false bridges in the colour selection electrode.

The latter solution (false bridges) has the serious drawback that these false bridges intercept the electrons, thus reducing the image intensity. Instead of a small number clearly visible lines a large number of lines are introduced. They are not individually visible but reduce the intensity of the image substantially.

The first solution (randomising) has been found by the inventors to result in negative effects on the image. The bridges are in many instances visible despite the randomisation and the image obtains a 'patchy' appearance.

SUMMARY OF THE INVENTION

It is an object of the invention to provide a cathode ray tube of the in the first paragraph described type in which the visibility of the bridges is reduced without reducing substantially the image intensity, and without getting a patchy appearance or at least reducing the chance for such an appearance.

To this end the cathode ray tube in accordance with the invention is characterised in that the bridges are formed in a regular repetitive pattern, wherein the pattern seen in a direction transverse to the longitudinal direction substantially repeats itself after n rows of slotted openings, the shift in a direction along the openings between adjacent rows being a multiple of approximately a distance $a_v/n$, and wherein n is greater than 4 and wherein $a_v/d_h \leqq n^2 \leqq 8a_v/d_h$ where $a_v$ is the vertical pitch of the openings and $d_h$ is the horizontal pitch between rows and wherein rows in which the respective patterns of openings are shifted in the direction along the elongated openings by $a_v/n$ or $-a_v/n$ are more than n/4 rows apart.

Instead of randomising the pattern of bridges is made repetitive with a high number order of repetition (n). The length of the openings is considerably larger then for standard shadow masks ($a_v \geqq 5$ mm).

The inventors have realised that randomisation of the position of the bridges as described in U.S. Pat. No. 4,942,332 leads to unexpected problems. At some parts of the image the bridges become visible, namely there where a number of bridges happen to be at the same horizontal position, or where adjacent bridge happen to be spaced at such distances that Moiré effects occur, where at other parts they are not. The randomisation in fact does not change the distance between the bridges seen in a horizontal dimension by a large amount. The randomisation as described in U.S. Pat. No. 4,942,332 is for example 0.02", which means that on average the distance between adjacent bridges is 0.01" or 0.25 mm, and because of the randomisation the distance is sometimes much less. This still leads to lines being visible in the image, to which lines the human eye is very sensitive. Randomising invariantly also leads to clustering, resulting being visible in parts of the image. The human eye is very sensitive to such irregularities in the image. The image is perceived as 'patchy' because of this effect. In some sense this problem is a greater problem than a straight line being visible. The straight line is always there and it is a problem that the viewer understands and will most likely be at least to some degree be visible when the device is bought and will effect all modes of image reproduction in more or less the same degree. The 'patchy' image due to randomisation is something that is dependent of the image that is displayed, and also on the particular mode (VGA, UGA, XVGA etc) with which the image is displayed. These problems become usually visible at higher resolution of the image, i.e. the higher the image quality. Such problems manifest themselves more often than not after sale and effect in particular the high quality image modes, leading to the clearly unwanted effect that the 'lower image quality' in fact gives a higher quality image than the 'high quality image'.

Repetitive patterns, if of high enough symmetry (n greater than 4) are much less visible then the two lines of the prior art. In fact the 'intensity' of the straight lines are reduced by at least a factor 2.5, which is sufficient for most purposes. Furthermore, because the pattern is regular the effect of the bridges on the image is evenly distributed, and there will be no 'patches' in the image. There may still, however, occur visible lines in the image. The openings are shifted in respect of other rows by an amount of approximately $a_v/n$ or a multiple thereof ($2a_v/n$, $3a_v/n$, $4a_v/n$, . . . $(n-1)a_v/n$). It is remarked that a shift of $(n-1)a_v/n$ is the same as a shift of $-a_v/n$, a shift of $(n-2)a_v/n$ is the same as $-2a_v/n$ etc. The condition $a_v/d_h \leqq n^2 \leqq 8a_v/d_h$ and the condition that the rows in which the respective patterns of openings are shifted in the direction along the elongated openings by approximately $a_v/n$ or $-a_v/n$ are spaced apart further than n/4 rows in a direction perpendicular to elongated openings, reduce the occurrence and visibility of such lines to such a large degree that they are not or hardly visible.

Preferably $a_v/d_h \leqq n^2 \leqq 4a_v/d_h$, even more preferably $2a_v/d_h \leqq n^2 \leqq 4a_v/d_h$, most preferably $n^2 \approx 2a_v/d_h$. (i.e. differing less than 25% from each other) These ranges gives the best results.

Preferably the rows in which the respective patterns of openings are shifted in the direction along the elongated openings by $a_v/n$ or $-a_v/n$ are spaced apart n/3 to n/2 (rounded off to the nearest whole number) rows in a direction perpendicular to elongated openings.

It is remarked that within the concept of the invention a small tilt of a few degrees of the pattern as a whole is possible. Strictly speaking, when a pattern repeats itself after n rows, for instance after 10 rows with a value of $a_v$ of 10 mm, and a value of $d_h$ of 0.22 mm, and in addition a small tilt of for instance 5 degrees is added, the pattern as seen along the line of tilt repeats itself after 10 rows, but strictly speaking seen along a horizontal line, the pattern, because of the small tilt, repeats itself after a much larger number of rows (or not at all). For instance a tilt of 5 degrees will make the pattern repeat itself after some 50 mm in the horizontal direction i.e. after some 225 rows. Patterns with, a small tilt, leading to patterns which, but for the tilt, repeat themselves after n rows fall within the scope of the invention. Likewise patterns which include a gradual change in the value of $a_v$, which would introduce effects similar to a small tilt, fall within the scope of the invention. In general if the effects of such higher order additions are, within the basic repetitive pattern of n rows, less than approximately $0.25a_v/n$ (in horizontal direction) and preferably less than $0.10a_v/n$ the resulting patterns are within the scope of the invention.

BRIEF DESCRIPTION OF THE DRAWINGS

These and further aspects of the invention will be explained in greater detail by way of example and with reference to the accompanying drawings, in which.

DETAILED DESCRIPTION OF THE INVENTION

Figure 1:
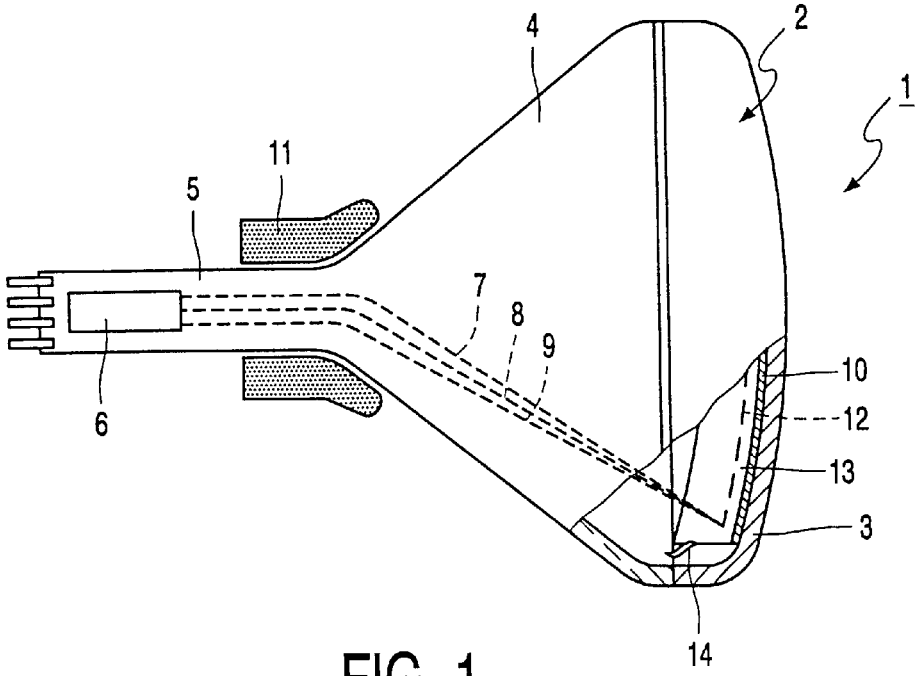
FIG. 1 is a display device.

The Figs. are not drawn to scale. In general, like reference numerals refer to like parts.

A colour display device 1 (FIG. 1) includes an evacuated envelope 2 comprising a display window 3, a cone portion 4 and a neck 5. In said neck 5 there is provided an electron gun 6 for generating three electron beams 7, 8 and 9. A display screen 10 is present on the inside of the display window. Said display screen 10 comprises a phosphor pattern of phosphor elements luminescing in red, green and blue. On their way to the display screen the electron beams 7, 8 and 9 are deflected across the display screen 10 by means of a deflection unit 11 and pass through a shadow mask 12 which is arranged in front of the display window 3 and which comprises a thin plate having apertures 13. The shadow mask is suspended in the display window by means of suspension means 14. The three electron beams converge and pass through the apertures of the shadow mask at a small angle with respect to each other and, consequently, each electron beam impinges on phosphor elements of only one colour. In FIG. 1 the axis (z-axis) of the envelope is also indicated.

Figure 2A:
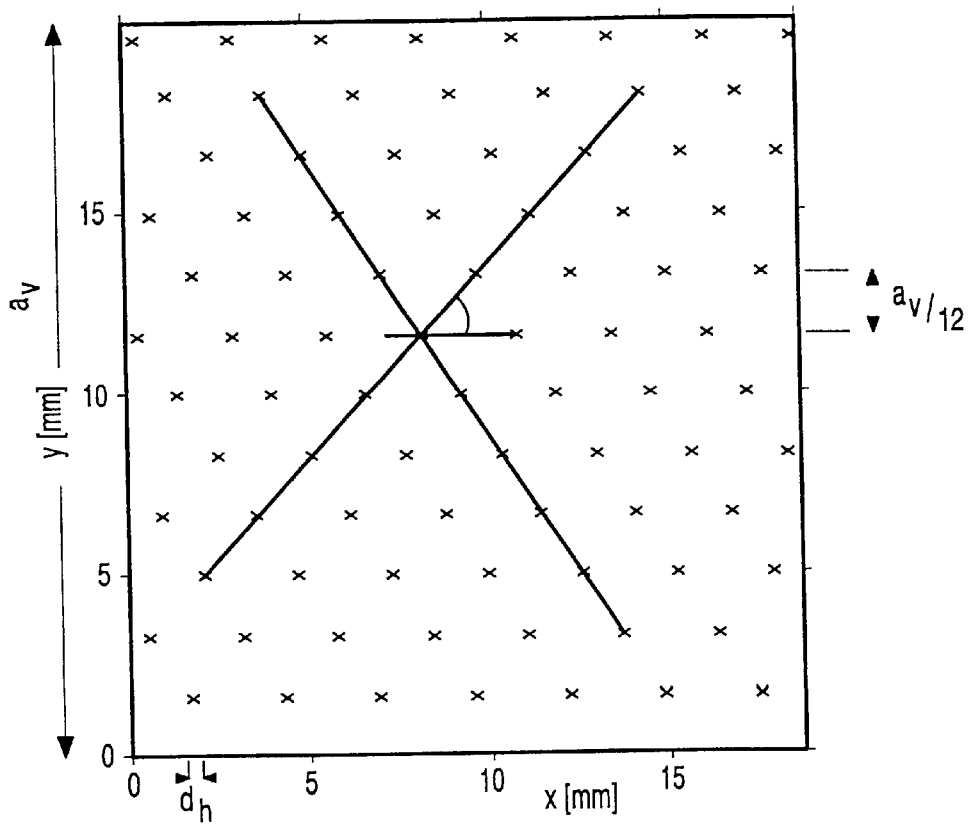
FIGS. 2A and 2B shows schematically a part of colour selection electrode for a CRT in accordance with the invention.

FIG. 2A shows schematically a part of a colour selection electrode for a CRT in accordance with the invention.

The longitudinal dimension of the slotted openings is p, the vertical pitch $a_v=p+d_v$, where $d_v$ is the dimension of the bridge and where $a_v$ is at least 5 mm. The pitch between adjacent rows is $d_h$. For simplicity in FIGS. 2A and 2B only the bridges are indicated, it is remarked that in between the rows the mask extends. The pattern of the slotted openings in the colour selection electrode repeats itself after a number n of rows (more than 4; in this case 12). The distance between bridges in adjacent rows is a multiple of $a_v/n$ (in this case $5a_v/12$).

One possible arrangement is where the vertical position of the bridges (starting with 0 for a given bridge 21) is 0, $5a_v/10$, $10a_v/12(=-2a_v/12)$, $3a_v/12$, $8a_v/12$, $1a_v/12$, $6a_v/12$, $11a_v/12(=-1a_v/12)$, $4a_v/12$, $9a_v/12$, $2a_v/12$, $7a_v/12$, $12a_v/12(=0)$.

The distance in vertical direction between bridges in adjacent rows is for each pair of adjacent rows $5a_v/12$. The most visible lines of bridges are those in which the step in horizontal direction is either $1a_v/12$ or $-1a_v/12$. They occur 5 rows spaced from each other. In the FIG. these lines are clearly distinguishable and indicated by lines.

The tangent of the angle that these lines make with the horizontal direction is the vertical distance ($a_v/12$) divided by the horizontal distance ($5d_h$) respectively ($7d_h$) i.e. $a_v/5d_h12$ and $a_v/7d_h12$. In this particular example $a_v=20$ mm, $d_h=0.22$ mm so that the two lines makes angles of 56.6° and 47.3°.

In general the tangent of these most prominent lines is the vertical distance ($a_v/n$ or $-a_v/n$) divided by the horizontal distance $d_hm$ where $2 \leqq m \leqq n$.

Figure 2B:
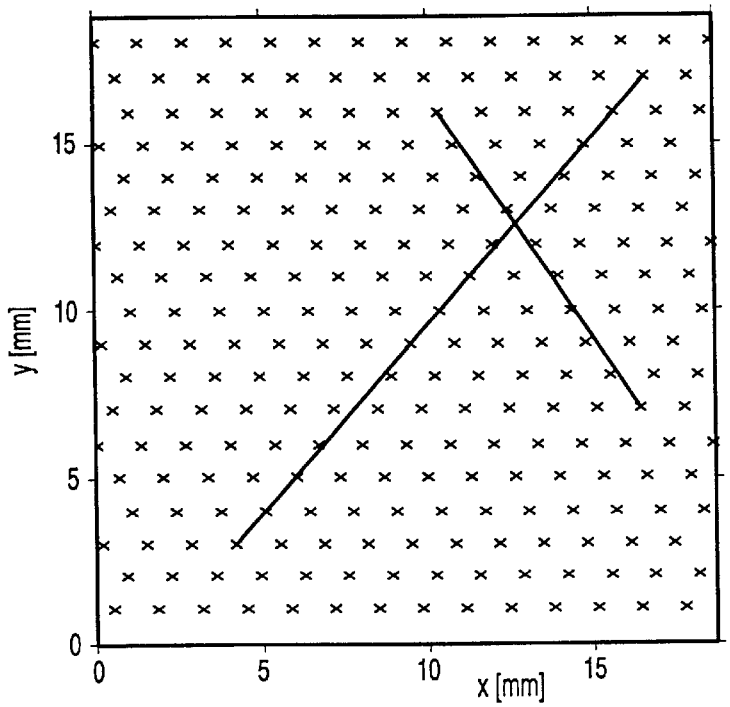

FIG. 2B shows a shadow mask having a six-fold symmetry, the vertical positions are 0, 3/6, 5/6, 1/6, 4/6, 2/6, 0

The distance $a_v=6$ mm leads to angles of 66° and 55°.

The most prominent lines are least visible if $n/4 \leqq m \leqq n/2$, preferably close to n/2 and if the tangent lies between approximately 0.5 and 2, preferably close to 1, i.e. the angle lies around 45°.

This condition to the tangent leads to $$0.5 \leqq a_v/(mnd_h) \leqq 2$$

and, with the condition $$n/4 \leqq m \leqq n/2$$

this leads to $$1 \leqq 8a_v/(n^2 d_h) \leqq 8$$

or $$a_v/d_h \leqq n^2 \leqq 8av/d_h$$

Preferably m is closer to n/2 and the tangent is closer to 1 leading to $$a_v/d_h \leqq n^2 \leqq 4a_v/d_h$$

Most preferably m is close to n/2 and the tangent is close to 1 leading to an optimum condition of $$2a_v/(n^2 d_h) \approx 1 \text{ or } n^2 \approx 2av/d_h$$

In the particular example of FIG. 2A $n^2=144$ and $a_v/d_h=90$ ($n^2=1.6a_v/d_h$) which is close to the optimum.

In the example of FIG. 2B $n^2$=36 and $a_v/d_h$=27.27 giving $n^2=1.32a_v/d_h$ slightly further away from the optimum than the example of FIG. 2A. Indeed comparing FIGS. 2A to 2B it is clear that the visual appearance of FIG. 2A is better than that of FIG. 2B.

Table 1 below indicates the visible appearance of several arrangements. The value for $d_h$ is 0.22 mm for all patterns, the value for $a_v$ is given. By means of minuses and plusses the visual impression is indicated.

Below the patterns used are indicated as well as (in table I) the value for $n^2$ (in $a_v/d_h$) and the number of rows after which the distance to the starting row is $a_v/n$ (or $-a_v/n$), such rows are also indicated in bold and underlined.

| | |
|---|---|
| n = 2 | (0, 1/2, 0) |
| n = 4 | (0, 2/4, **3/4**, **1/2**, 0) |
| n = 6 | (0, 3/6, 5/6, 1/6, 4/6, 2/6, 0) |
| n = $8^1$ | (0, 3/8, 6/8, **1/8**, 4/8, **7/8**, 2/8, 5/8, 0) |
| n = $8^2$ | (0, 4/8, **7/8**, 2/8, 5/8, **1/8**, 6/8, 3/8, 0) |
| n = 11 | (0, 3/11, 6/11, 9/11, **1/11**, 4/11, 7/11, **10/11**, 2/11, 5/11, 8/11, 0) |
| n = 12 | (0, 5/12, 10/12, 3/12, 8/12, **1/12**, 6/12, **11/12**, 4/12, 9/12, 2/12, 7/12, 0) |
| n = $17^1$ | (0, 7/17, 14/17, 4/17, 11/17, **1/17**, 8/17, 15/17, 5/17, 12/17, 2/17, 9/17, **16/17**, 6/17, 13/17, 3/17, 10/17, 0) |
| n = $17^2$ | (0, 8/17, **16/17**, 7/17, 15/17, 6/17, 14/17, 5/17, 13/17, 4/17, 12/17, 3/17, 11/17, 2/17, 10/17, **1/17**, 9/17, 0) |
| n = 19 | (0, 8/19, 16/19, 5/19, 13/19, 2/19, 10/19, **18/19**, 7/19, 15/19, 4/19, 12/19, **1/19**, 9/19, 17/19, 6/19, 14/19, 3/19, 11/19, 0) |

In table I it is also indicated in which range of the invention the patterns fall. The darkest range is outside the scope of the invention. The whitest range is the most preferred range as indicated below. The second pattern with n=17 (indicated by $17^2$) is outside the range of the invention because the rows having a distance of $a_v/17$ are only two rows separated from each other which is less than ¼ of 17 (4.25). The most preferred patterns are those that have regular distance in the vertical direction between adjacent rows. The very best patterns are for n=12, with slightly less favourable for n=10 or 14.

Figure 3:
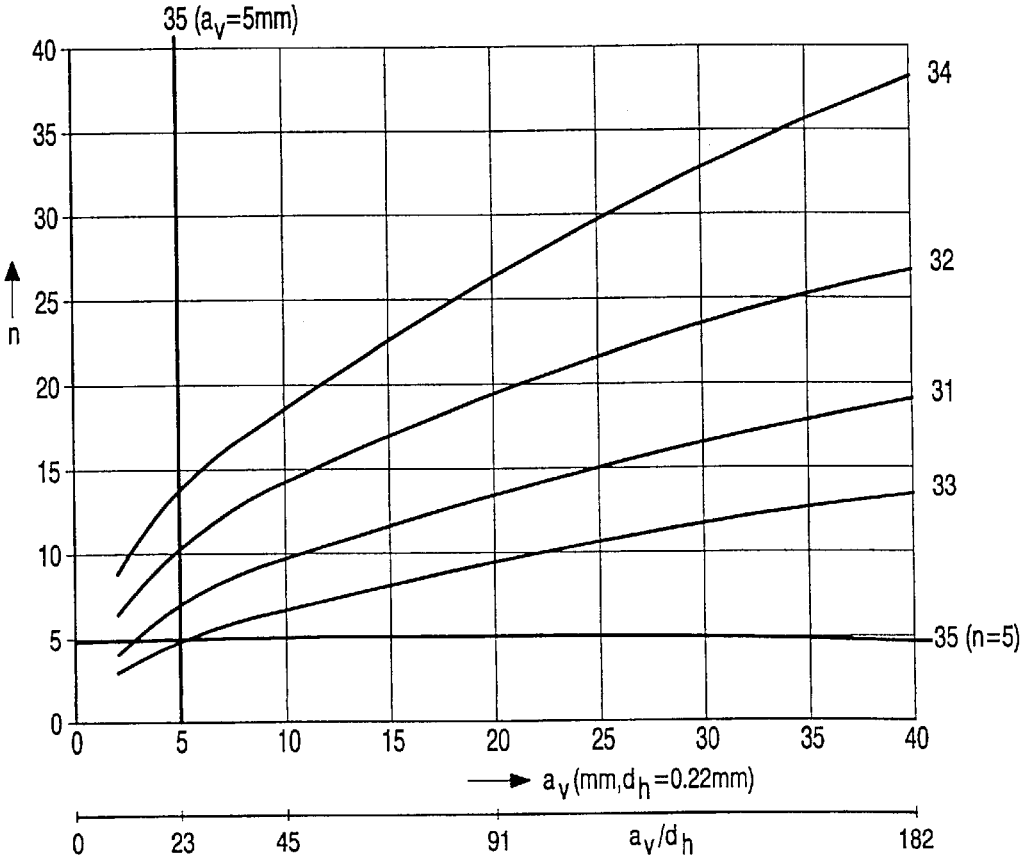
FIG. 3 shows in a graphical form the range and preferred ranges of the invention.

FIG. 3 shows in a graphical form the relation between n (number of rows after which (apart from a possible small angle tilt) the pattern of rows repeats itself) and $a_v$ for a value of $d_h$ of 0.22 mm. The second horizontal base gives the values of $a_v/d_h$. Line 31 indicates the optimum values, lines 32 and 33 delimit the preferred range and lines 32 and 34 delimit the outer ranges of the invention. Lines 35 and 36 delimit $a_v$=5 mm respectively n=5. Preferably n≧8.

Most preferably, especially for values of $a_v/d_h$ of larger than 50, are n=8 or n=12. These give the most symmetrical patterns. It is remarked that apart from having a positive influence on the visual appearance of the image, the invention also has a positive effect on the strength and more in particular on the homogeneity of the stress in the mask f the mask. Because of the pattern of bridges the distribution of stress, more in particular the homogeneity of the stress in the mask is improved.

In short the invention can be described by:

A cathode ray tube having a tensioned shadow mask with elongated holes, i.e. holes with a length longer than 5 mm. The pattern of holes repeats itself after 5 or more rows and the relation between the number of rows after which the pattern repeats itself, the vertical pitch $a_v$ and the horizontal pitch $d_h$ is given by $a_v/d_h \leqq n^2 \leqq 8a_v/d_h$, most preferably $n^2 \approx 2a_v/d_h$.

TABLE I visual impression of shadow masks

| | $a_v$ = 2 | $a_v$ = 4 | $a_v$ = 5 | $a_v$ = 6 | $a_v$ = 10 | $a_v$ = 15 | $a_v$ = 20 | $a_v$ = 30 | $a_v$ = 40 |
|---|---|---|---|---|---|---|---|---|---|
| n = 2 | | - - - $n^2$ = 0.22 | - - - $n^2$ = 0.18 | | - - $n^2$ = 0.09 | | | | |
| n = 4 | - - | - - - $n^2$ = 0.88 | - - $n^2$ = 0.7 | - - | - $n^2$ = 0.35 | | | | |
| n = 6 | - - $n^2$ = 3.96 | | + $n^2$ = 1.74 | + + $n^2$ = 1.32 | | $n^2$ = 0.53 | | | |
| n = $8^1$ | - $n^2$ = 7.04 | | + $n^2$ = 2.81 | | + + $n^2$ = 1.41 | + + $n^2$ = 0.94 | o $n^2$ = 0.70 | | |
| n = $8^2$ | - - | | o $n^2$ = 2.81 | | | | | | |
| n = 11 | | | | | | | + + + $n^2$ = 1.33 | | |
| n = 12 | | | o $n^2$ = 6.33 | | + $n^2$ = 3.17 | + + $n^2$ = 2.11 | + + + $n^2$ = 1.58 | + + $n^2$ = 1.06 | 0 $n^2$ = 0.79 |
| n = $17^1$ | | | | | | | + $n^2$ = 3.18 | | |
| n = $17^2$ | | | | | | | - | | |
| n = 19 | | | - $n^2$ = 15.8 | | O $n^2$ = 7.94 | + $n^2$ = 5.29 | + $n^2$ = 3.97 | + + $n^2$ = 2.65 | + + $n^2$ = 1.99 |

What is claimed is:

1. Cathode ray tube with a tensioned colour selection electrode in which electrode tension is applied in a direction and the colour selection electrode comprises elongated openings in said direction, the openings being separated from each other in said direction by bridges, the dimension of said openings in said direction being more than 5 mm, characterised in that that the bridges are formed in a regular repetitive pattern, wherein the pattern seen in a direction transverse to the longitudinal direction substantially repeats itself after n rows of slotted openings, the shift in a direction along the openings between adjacent rows being a multiple of approximately a distance $a_v/n$, and wherein n is greater than 4 and wherein $$a_v/d_h \leqq n^2 \leqq 8a_v/d_h$$

where $a_v$ is the vertical pitch of the openings and $d_h$ is the horizontal pitch between rows and wherein rows in which the respective patterns of openings are shifted in the direction along the elongated openings by $a_v/n$ or $-a_v/n$ are more than n/4 rows apart.

2. Cathode ray tube as claimed in claim 1, characterised in that $a_v/d_h \leqq n^2 \leqq 4a_v/d_h$.

3. Cathode ray tube as claimed in claim 1, characterised in that $n^2 \approx 2a_v/d_h$.

4. Cathode ray tube as claimed in claim 1, characterised in that $n \geqq 8$.

5. Cathode ray tube as claimed in claim 4, characterised in that n=10 to 14.

6. Cathode ray tube as claimed in claim 5, characterised in that n=12.

* * * * *